US006662722B2

(12) United States Patent
Frankenberger et al.

(10) Patent No.: US 6,662,722 B2
(45) Date of Patent: Dec. 16, 2003

(54) MACHINE FOR PROCESSING SHEETS HAVING SPRING MOUNTED THROTTLED AIR NOZZLES

(75) Inventors: Eckart Frankenberger, Darmstadt (DE); Michael Gieser, Oftersheim (DE); Christian Gorbing, Heidelberg (DE); Peter Hachmann, Dossenheim (DE); Karl-Heinz Helmstädter, Heidelberg (DE); Christian Hieb, Neuhofen (DE); Ruben Schmitt, Heidelberg (DE); Günter Stephan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/944,570

(22) Filed: Aug. 31, 2001

(65) Prior Publication Data

US 2002/0096068 A1 Jul. 25, 2002

(30) Foreign Application Priority Data

Aug. 31, 2000 (DE) ..... 100 42 887

(51) Int. Cl.[7] ..... B41F 21/10; B41F 22/00

(52) U.S. Cl. ..... 101/232; 101/231; 101/420; 271/276; 406/88

(58) Field of Search ..... 101/142, 231, 101/232, 420; 271/194, 195, 196, 197, 276; 738/37, 40, 42, 44; 406/88

(56) References Cited

U.S. PATENT DOCUMENTS

| | | | | | |
|---|---|---|---|---|---|
| 3,823,743 | A | * | 7/1974 | King | 138/42 |
| 4,043,360 | A | * | 8/1977 | Yaron | 138/42 |
| 4,411,292 | A | * | 10/1983 | Schiller | 138/42 |
| 5,156,090 | A | * | 10/1992 | Wirz | 101/142 |
| 5,186,107 | A | * | 2/1993 | Wieland | 101/409 |
| 5,327,941 | A | * | 7/1994 | Bitsakis et al. | 138/42 |
| 5,816,155 | A | * | 10/1998 | Stephan | 101/232 |
| 6,270,074 | B1 | * | 8/2001 | Rasmussen et al. | 271/276 |

FOREIGN PATENT DOCUMENTS

| | | |
|---|---|---|
| DE | 35 36 536 A 1 | 6/1986 |
| DE | 44 36 955 C 2 | 4/1996 |
| DE | 199 05 095 A 1 | 8/2000 |

* cited by examiner

*Primary Examiner*—Andrew H. Hirshfeld
*Assistant Examiner*—Leo T. Hinze
(74) *Attorney, Agent, or Firm*—Laurence A. Greenberg; Werner H. Stemer; Ralph E. Locher

(57) ABSTRACT

A machine for processing sheets, in particular a sheet-fed rotary printing machine, includes a transporting cylinder for transporting the sheets and having air nozzles disposed offset in relation to one another in a direction other than an axis-parallel direction of the transporting cylinder, and having a directing configuration for directing the sheets and having air nozzles, the configuration being assigned to the transporting cylinder. The machine is distinguished in that the air nozzles include throttled air nozzles and unthrottled air nozzles.

13 Claims, 6 Drawing Sheets

MACHINE FOR PROCESSING SHEETS HAVING SPRING MOUNTED THROTTLED AIR NOZZLES

BACKGROUND OF THE INVENTION

Field of the Invention

The invention relates to a machine for processing sheets, in particular, to a sheet-fed rotary printing machine, having a transporting cylinder for transporting the sheets, the cylinder having air nozzles offset in relation to one another in a direction other than an axis-parallel direction of the transporting cylinder, and having a directing configuration for directing the sheets, the configuration having air nozzles and being assigned to the transporting cylinder.

German Published, Non-Prosecuted Patent Application DE 35 36 536 A1 describes such a machine, of which the transporting cylinder is configured as a blowing-air drum and the directing configuration is constructed as a blowing plate. The blowing-air drum and the blowing plate have blowing-air nozzles, the configuration of which is not discussed in any more detail therein. As the sheet is being relieved of stressing, with the associated dissipation of its kinetic energy, the sheet is intercepted on an air cushion produced by the blowing nozzles disposed on segments of the blowing-air drum. In order for the sheet to have a larger acceleration path, it is necessary for the segments to be pivoted out.

Disadvantage of the prior art device include, on one hand, the construction of the blowing-air drum involves high outlay as a result of the segments and, on the other hand, the sheets still run in a comparatively unstable manner.

SUMMARY OF THE INVENTION

It is accordingly an object of the invention to provide a machine for processing sheets that overcomes the hereinafore-mentioned disadvantages of the heretofore-known devices of this general type and that ensures that the sheets run in a particularly stable manner.

With the foregoing and other objects in view, there is provided, in a sheet processing machine having a transporting cylinder for transporting sheets, the transporting cylinder having a longitudinal axis, in accordance with the invention, a sheet transporting device includes air nozzles disposed in the transporting cylinder and a directing configuration for directing the sheets along the transporting cylinder. The air nozzles are disposed offset in relation to one another in a direction at an angle to the longitudinal axis. The directing configuration has directing air nozzles and cooperates with the transporting cylinder to transport the sheets between the directing configuration and the transporting cylinder. The air nozzles and the directing air nozzles include throttled air nozzles and unthrottled air nozzles. Preferably, the sheet processing machine is a sheet-fed rotary printing machine.

It is possible to have different sheet-stabilizing combinations of the throttled air nozzles with the unthrottled air nozzles. The throttled air nozzles having a comparatively steep characteristic curve of pneumatic action in the vicinity of the nozzles and the unthrottled air nozzles having a comparatively shallow characteristic curve of pneumatic action in the vicinity of the nozzles.

In accordance with another feature of the invention, the transporting cylinder only has the throttled air nozzles and the directing configuration has both the throttled air nozzles and the unthrottled air nozzles.

In accordance with a further feature of the invention, the transporting cylinder only has the throttled air nozzles and the directing configuration only has the unthrottled air nozzles.

In accordance with an added feature of the invention, the transporting cylinder only has the unthrottled air nozzles and the directing configuration only has the throttled air nozzles.

In accordance with an additional feature of the invention, the transporting cylinder only has the unthrottled air nozzles and the directing configuration has both the throttled air nozzles and the unthrottled air nozzles.

In accordance with yet another feature of the invention, the transporting cylinder has both throttled air nozzles and the unthrottled air nozzles and the directing configuration only has the throttled air nozzles.

In accordance with yet a further feature of the invention, the transporting cylinder has both some of the throttled air nozzles and some of the unthrottled air nozzles and the directing configuration has the rest of the throttled air nozzles and the rest of the unthrottled air nozzles.

In accordance with yet an added feature of the invention, the directing air nozzles include the throttled air nozzles and the unthrottled air nozzles.

Of the six variants mentioned, those in which the directing configuration has throttled air nozzles and unthrottled air nozzles are preferred.

Configurations of the air nozzles as blowing-air and/or suction-air nozzles that are described hereinbelow are possible in combination with all six previously mentioned variants of associated the air nozzles to the transporting cylinder and to the directing configuration.

In accordance with yet an additional feature of the invention, the throttled air nozzles of the transporting cylinder and/or the unthrottled air nozzles of the transporting cylinder may be suction-air nozzles. As such, the transporting cylinder is referred to as a suction-air drum.

The transporting cylinder is preferably configured as a blowing-air drum. As such, the throttled air nozzles of the transporting cylinder and/or the unthrottled air nozzles of the transporting cylinder are configured as blowing-air nozzles. It is preferable for both the throttled and the unthrottled air nozzles of the transporting cylinder to be configured as blowing-air nozzles.

The throttled air nozzles of the directing configuration and/or the unthrottled air nozzles of the directing configuration may be suction-air nozzles. As such, the directing configuration is referred to as a suction-air box, bar, or rake.

The directing configuration is preferably configured as a blowing-air box, bar, or rake. As such, the throttled air nozzles of the directing configuration and/or the unthrottled air nozzles of the directing configuration are configured as blowing-air nozzles. It is preferable for both the throttled and the unthrottled air nozzles of the directing configuration to be configured as blowing-air nozzles.

In accordance with again another feature of the invention, at least one of the air nozzles and the directing air nozzles have joints, and the throttled air nozzles are movably mounted in the joints.

In accordance with again a further feature of the invention, the throttled air nozzles include springs and are resiliently mounted in at least one of the air nozzles and the directing air nozzles by the springs.

In accordance with again an added feature of the invention, there is provided at least one air throttle fluidically communicating with at least one of the throttled air nozzles and the directing air nozzles. Each of the above-mentioned throttled air nozzles of the directing configuration and/or the transporting cylinder can be connected pneumatically to an air-pressure generator through an air throttle.

With the air-pressure generator preferably being configured as a positive-pressure generator that generates blowing air, the throttled air nozzle or each throttled air nozzle connected to the positive-pressure generator through the air throttle is a throttled blowing-air nozzle.

With the air-pressure generator possibly being configured as a suction-air generator, or a negative-pressure generator that generates a vacuum, the throttled air nozzle or each throttled air nozzle connected to the negative-pressure generator through the air throttle is a suction-air nozzle.

The air throttle may be integrated, at a distance from a respective throttled air nozzle, in an air-directing system to which the throttled air nozzles are connected. The integration is favorable if the air throttle provided is one that is connected pneumatically to a plurality of the throttled air nozzles at the same time through the air-directing system. The air throttle and the air nozzle throttled by the air throttle may also form a structural unit in the form of a throttle nozzle. In the last-mentioned case, each of the throttled air nozzles (throttle nozzles) is assigned a dedicated air throttle that is disposed in the throttled air nozzle (throttle nozzle).

In accordance with again an additional feature of the invention, a loose-fill column is located in the air throttle as a constituent part of the air throttle. The loose-fill elements of the loose-fill column form flow resistances for the suction air or blowing air flowing through the air throttle and generated by the air-pressure generator.

In accordance with still another feature of the invention, an air-filter-like throttle element is located in the air throttle as a constituent part of the air throttle. The throttle element forms a flow resistance for the suction air or blowing air. The throttle element is, for example, a textile layer that may be woven or non-woven. It is also possible, however, for the throttle element to be a porous and, thus, air-permeable sponge made of foamed plastic.

In accordance with still a further feature of the invention, the air throttle is provided with air weirs that project into the flow path of the suction air or blowing air and bound vortex chambers.

In accordance with still an added feature of the invention, the air throttle is a helical air channel.

In accordance with still an additional feature of the invention, the air throttle is configured as a so-called perforated-plate labyrinth and includes perforated plates disposed one above another and vortex chambers located between the plates.

With the objects of the invention in view, there is also provided a sheet processing machine having a transporting cylinder for transporting sheets, the machine including air nozzles disposed in a transporting cylinder having a cylinder longitudinal axis and a directing configuration for directing the sheets. The air nozzles are disposed offset in relation to one another in a direction at an angle to the cylinder longitudinal axis. The directing configuration has directing air nozzles and cooperates with the transporting cylinder to transport the sheets between the directing configuration and the transporting cylinder. The air nozzles and the directing air nozzles include throttled air nozzles and unthrottled air nozzles.

Other features that are considered as characteristic for the invention are set forth in the appended claims.

Although the invention is illustrated and described herein as embodied in a machine for processing sheets, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
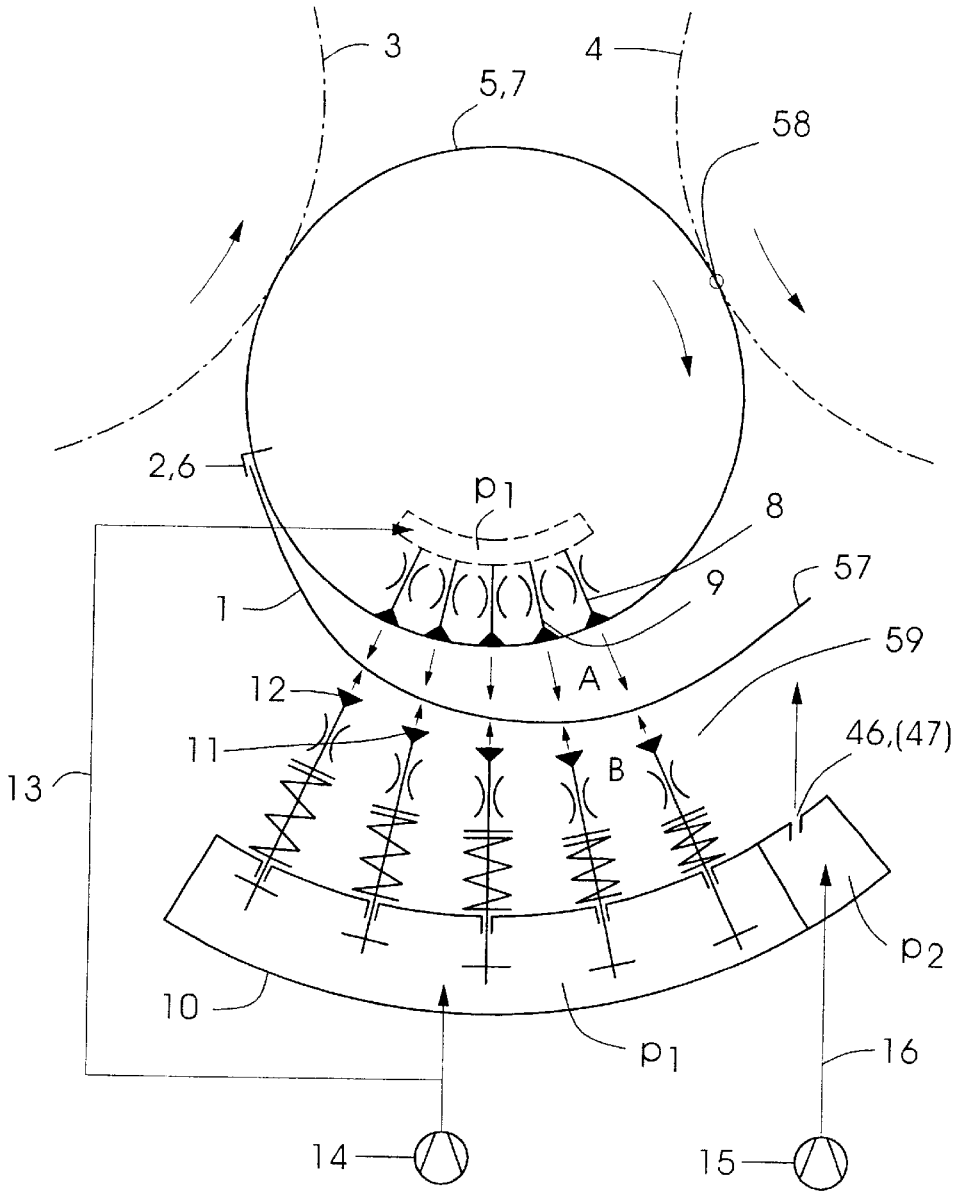
FIG. 1 is a fragmentary, diagrammatic, cross-sectional view of a sheet-processing machine with a directing configuration according to the invention.

In all the figures of the drawing, sub-features and integral parts that correspond to one another bear the same reference symbol in each case. Related applications having the application Ser. Nos. (Attorney Docket Nos. A-2904, A-2905, and A-2935) are hereby incorporated herein by reference.

Referring now to the figures of the drawings in detail and first, particularly to FIG. 1 thereof, there is shown a sheet-fed rotary printing machine as an example of a machine 2 that processes sheets 1. Two cylinders 3, 4 that guide the sheet 1 have disposed between them a transporting cylinder 5, by which the sheet 1 that has been newly printed on both sides in the machine 2 is received from the cylinder 3 and transferred to the cylinder 4. The cylinders 3, 4 are impression cylinders in various printing units of the machine 2. The transporting cylinder 5 has a circular profile and has at least one row of grippers 6 for retaining the sheet 1 at a leading edge of the sheet, and also has throttled air nozzles 8, 9 that function as blowing-air nozzles, in a circumferential surface 7.

The air nozzles 8, 9 are disposed in a nozzle row that extends longitudinally in the circumferential direction of the transporting cylinder 5. The circumferential direction is not parallel to the axis of rotation of the transporting cylinder 5. Although it cannot be seen from FIG. 1, the air nozzles 8, 9 nevertheless belong not just to the nozzle row extending in the circumferential direction but, at the same time, also to further nozzle rows that extend longitudinally in an axis-parallel direction to the axis of rotation of the transporting cylinder 5. Thus, the air nozzles 8, 9 form points of intersection of a nozzle grid configuration in which the nozzle rows running in an axis-parallel direction intercept the nozzle row running in the circumferential direction.

Disposed in a stationary manner in the immediate vicinity of the transporting cylinder 5, beneath the transporting cylinder 5, is a directing configuration 10, of which the directing surface provided with throttled air nozzles 11, 12 and unthrottled air nozzles 46, 47 is curved around the transporting cylinder 5 in an approximately equidistant manner in relation to the cylinder 5. The air nozzles 11, 12, and 46, 47 function as blowing-air nozzles. The throttled air nozzles 8, 9 and 11, 12, having an air-outlet direction in a radial direction relative to the transporting cylinder 5, are connected pneumatically to a first air-pressure generator 14 through a first air-directing system 13. The air-pressure generator 14 subjects the first air-direction system 13 to an air pressure or positive pressure $P_1$ that is much greater than an air pressure or positive pressure $P_2$ to which a second air-pressure generator 15 subjects a second air-directing system 16, i.e., $P_1 >> P_2$. The motor-driven air-pressure generators 14, 15 are fans suitable for generating blowing air. The second air-directing system 16 opens out in the unthrottled air nozzles 46, 47 of the directing configuration 10. The unthrottled air nozzles 46, 47 can be Venturi nozzles or pulsed-jet nozzles.

In FIG. 1, the air nozzle 46 conceals the air nozzle 47 located behind it, and such a concealed location is clarified by designating the concealed air nozzle with brackets. The unthrottled air nozzles 46, 47 have an air-outlet direction directed obliquely counter to the transporting direction of the sheet 1. To better clarify the functional principle, FIG. 1 schematically illustrates spring bearings of the throttled air nozzles 11, 12 of the directing configuration 10 in a way that differs from the actual construction. See, i.e., FIGS. 2 and 3.

Figure 2:
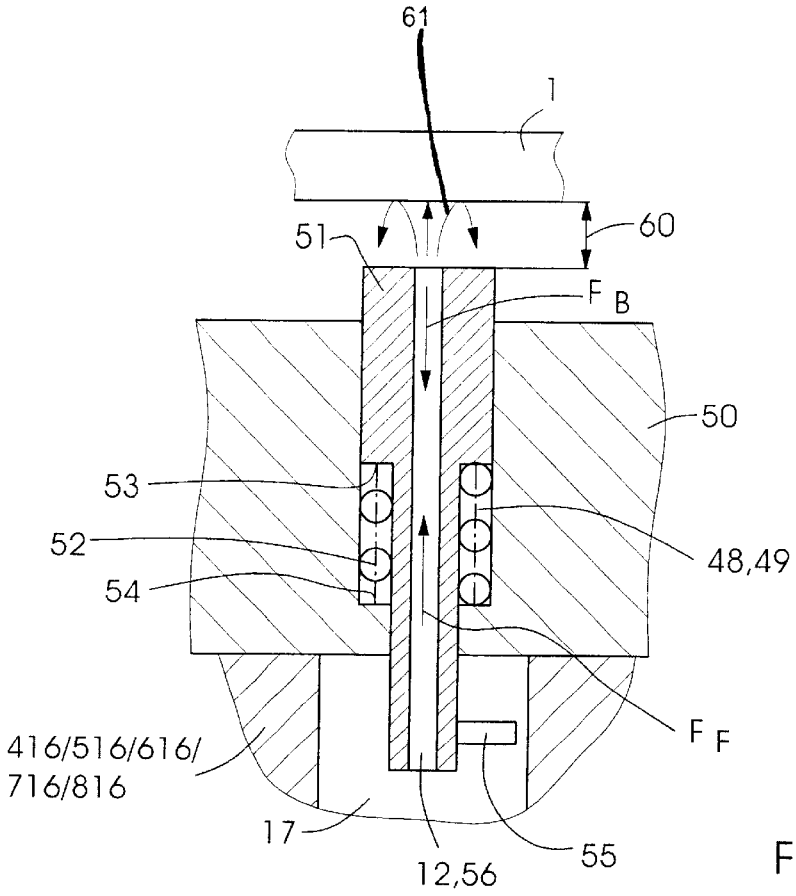
FIG. 2 is a fragmentary, diagrammatic, cross-sectional view of a resilient and throttled air nozzle of the directing configuration of FIG. 1 in a first position.
Figure 3:
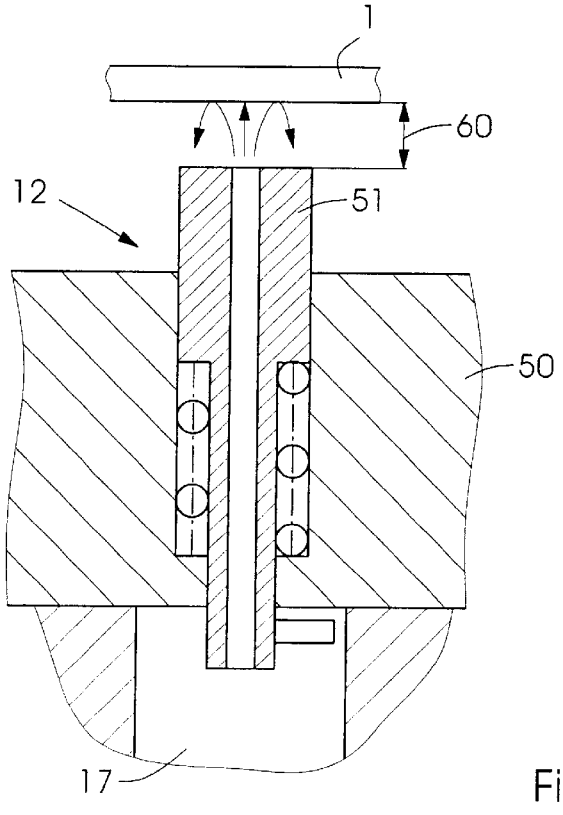
FIG. 3 is a fragmentary, diagrammatic, cross-sectional view of the air nozzle of FIG. 2 in a second different position.

With reference to FIGS. 2 and 3, the actual construction will be explained in detail using the air nozzle 12 to represent each of the throttled air nozzles 11, 12 of the directing configuration 10. The air nozzle 12 is mounted in a joint 48 configured as a sliding joint, such that it can be adjusted linearly in the direction of the transporting cylinder 5 and away from the same. The joint 48 includes a stepped joint bore 49 in a wall (top wall) 50, of which the top side forms the directing surface, and also includes a nozzle body 51 that is inserted displaceably into the joint bore 49 and is likewise stepped. A helical spring 52 that can be subjected to compressive loading is retained under prestressing between the nozzle body 51, which is fitted into the spring 52, and the wall 50. The spring 52, which is disposed in the joint bore 49 and is coiled around a tapered step formation of the nozzle body 51, is supported, by one end, on a thickened step formation 53 of the nozzle body 51 and, by its other end, on a shoulder 54 of the joint bore 49.

By virtue of striking against an underside of the wall 50, a radial protrusion 55 on the nozzle body 51, the protrusion 55 configured as a transverse pin, prevents, in certain operating situations, the spring 52 from forcing the nozzle body 51 too far out of the joint bore 49. An end of the nozzle body 51 that bears the protrusion 55 projects into a throttle outlet 17 of an air throttle that is disposed in the directing configuration 10, beneath the wall 50 and that is a constituent part of the first air-directing system 13. Different exemplary embodiments of the air throttle are designated 416, 516, 616, 716, 816. See FIGS. 4 to 8.

An air throttle corresponding to the air throttle 416, 516, 616, 716, 816 is assigned to each of the throttled air nozzles 8, 9 of the transporting cylinder 5 and to each of the throttled air nozzles 11, 12 of the directing configuration 10.

From the throttle outlet 17, the blowing air flows over into the nozzle body 51 or the nozzle bore 56 thereof. In each of the exemplary embodiments of the air throttle 416, 516, 616, 716, 816, the air throttle has the throttle outlet 17 in a throttle top 18 and a throttle inlet 19 in a throttle base 20. FIG. 1 represents the throttling of the throttled air nozzles 8, 9 and 11, 12 by the air throttle 416, 516, 616, 716, 816 in a highly schematic manner, the throttled air nozzles 8, 9 and 11, 12 being illustrated by the conventional throttle symbol.

The throttle top 18 and the throttle base 20 respectively form the top and bottom boundary of a throttle chamber 21 that is disposed therebetween and has the blowing air of the first air-pressure generator 14 flowing there through.

There are different exemplary embodiments for the air throttle 416, 516, 616, 716, 816 configuration, examples of which are shown in FIGS. 4 to 8 and are described below.

Figure 4:
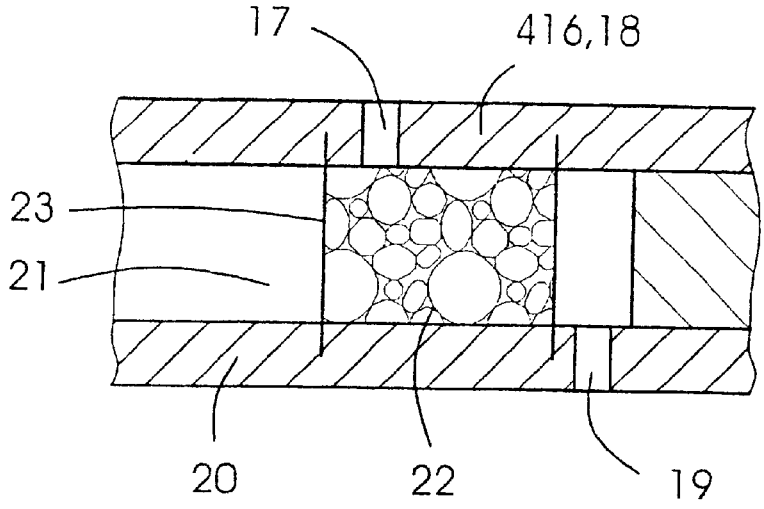
FIG. 4 is a fragmentary, diagrammatic, cross-sectional view of a first embodiment of an air throttle assigned to the throttled air nozzle of FIG. 2.

In the case of the air throttle 416 in FIG. 4, a loose fill 22 made of loose-fill elements, e.g., granules, fibers, chips, or balls, which is held together on both sides by a netting or meshing 23 is located in the air-flow path between the throttle inlet 17 and the throttle outlet 19 in the throttle chamber 21. The loose-fill elements may also be sintered to one another for stabilization purposes. Between the loose-fill elements, the loose fill 22 has inter-communicating cavities through which the blowing air flows. The loose fill 22 completely fills the cross section of the throttle chamber 21. As a result, all blowing air has to flow through the loose fill 22 and is throttled therein by build-ups against the loose-fill elements and vortices in the cavities.

Figure 5:
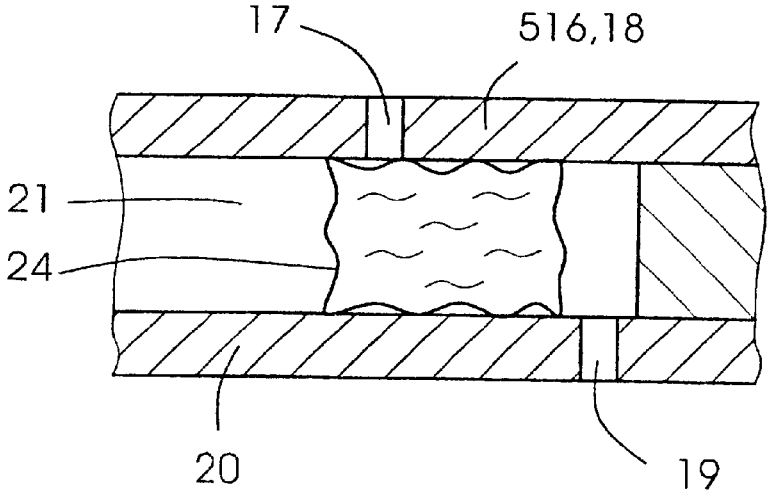
FIG. 5 is a fragmentary, diagrammatic, cross-sectional view of a second embodiment of the air throttle of FIG. 4.

In the case of the variant of the air throttle 516 of FIG. 5, the loose fill 22 is replaced by a textile throttle element 24, e.g., a woven fabric or non-woven, inserted into the throttle chamber 21. To fill the throttle chamber 21, from the throttle base 20 to the throttle top 18, with the filter-like throttle element 24, it is possible for the throttle element 24 to be made of a single sufficiently voluminous layer or to be wound into a multi-layered insert or to be mounted in a tensioned state in the throttle chamber 21. The blowing air flowing through the throttle element 24 is throttled by build-ups against filaments or fibers and by vortices in pores of the throttle element 24.

Figure 6A:
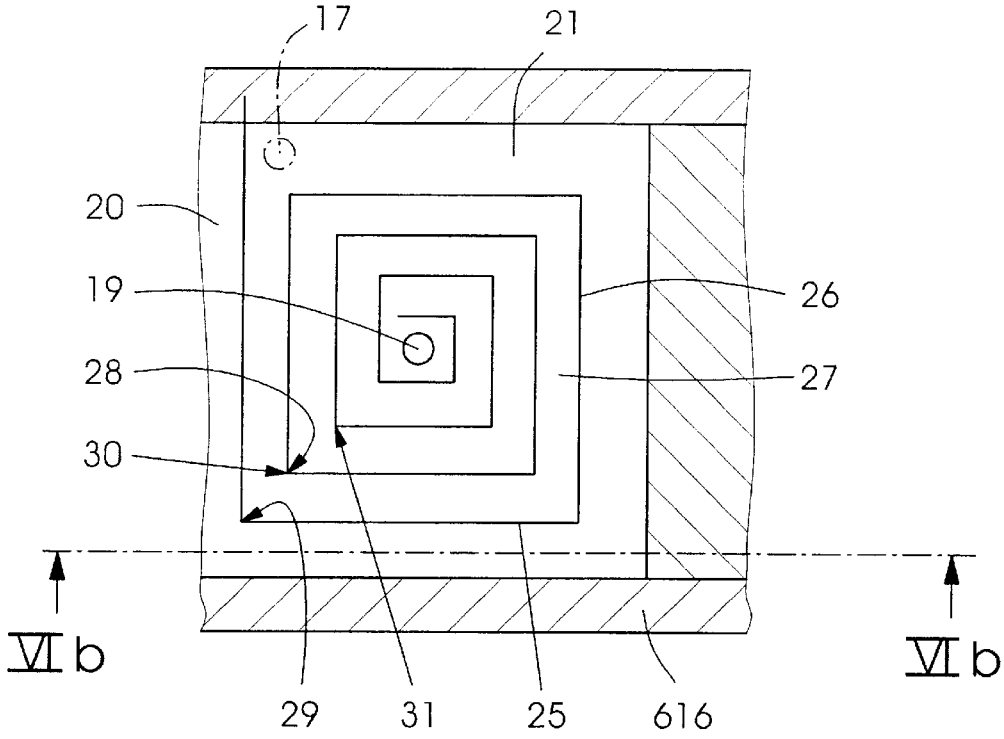
FIG. 6*a* is a fragmentary, diagrammatic, cross-sectional plan view of a third embodiment of the air throttle of FIG. 4.
Figure 6B:
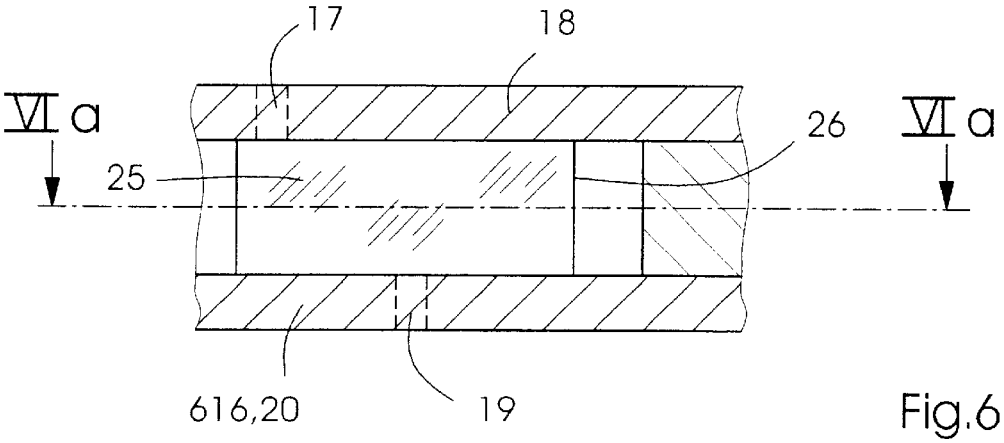
FIG. 6*b* is a fragmentary, diagrammatic, cross-sectional side view of the air throttle of FIG. 6*a;*

FIG. 6*a* (which is a horizontal cross-section along section line VIa—VIa in FIG. 6*b*) and FIG. 6*b* (which is a vertical cross-section along section line VIb—VIb in FIG. 6*a*) illustrate an air throttle 616 having air-directing walls 25 and 26 in the throttle chamber 21 disposed at an angle, in particular orthogonally, to one another. As a result, an air channel 27 that directs the blowing air, between the air-directing walls 25, 26, from the throttle inlet 17 to the throttle outlet 19 is produced in the form of a polygonal helix. The blowing air flowing through the air channel 27 builds up in corner angles 28, 29 of the air channel 27 and forms vortices against corner edges 30, 31 of the air-directing walls 25, 26. As a result, the air stream is throttled. The air-directing walls 25, 26 have a very pronounced level of surface roughness that is caused, for example, by treating the air-directing walls 25, 26 by sandblasting and that helps to reduce the flow speed of the blowing air in the air channel 27 by an increase in friction.

Figure 7A:
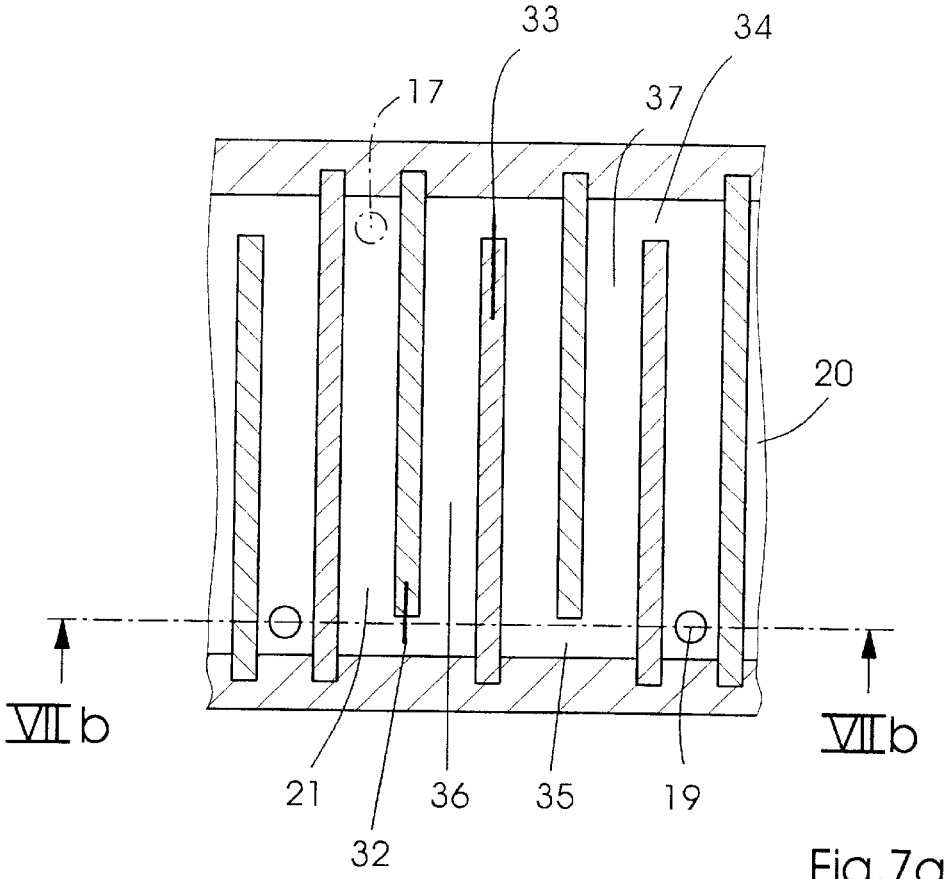
FIG. 7*a* is a fragmentary, diagrammatic, cross-sectional plan view of a fourth embodiment of the air throttle of FIG. 4.
Figure 7B:
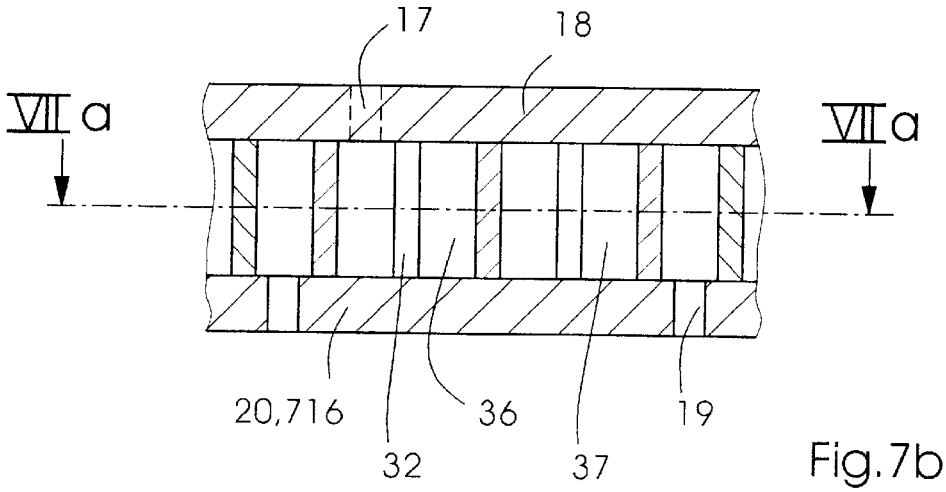
FIG. 7*b* is a fragmentary, diagrammatic, cross-sectional side view of the air throttle of FIG. 7*a*.

In the case of the air throttle 717 shown in FIG. 7*a* (which is a horizontal cross-section along section line VIIa—VIIa in FIG. 7*b*) and FIG. 7*b* (which is a vertical cross-section along section line VIIb—VIIb in FIG. 7*a*), the throttle chamber 21 is provided with air weirs 32, 33 in the form of build-up walls. The air weirs 32, 33 are disposed such that they alternate in two rows and overlap one another with the exception of narrow air gaps 34, 35. Located between the air weirs 32, 33 are vortex chambers 36, 37 that, together with the air gaps 34, 35, form a meandering air channel that leads from the throttle inlet 17 to the throttle outlet 19 and in which the blowing air is throttled.

It is also conceivable to have a sandwich construction of the air throttle 716, in which the throttle top 18 and the throttle base 19 are configured as lamellae between which an intermediate lamella is located, the meandering air channel and the vortex chambers being recessed therein. Such an air throttle can be produced cost-effectively, for example, by the intermediate lamella being punched out, and, with a number of air throttles 716 disposed together, can form a lamellar throttle assembly.

Figure 8:
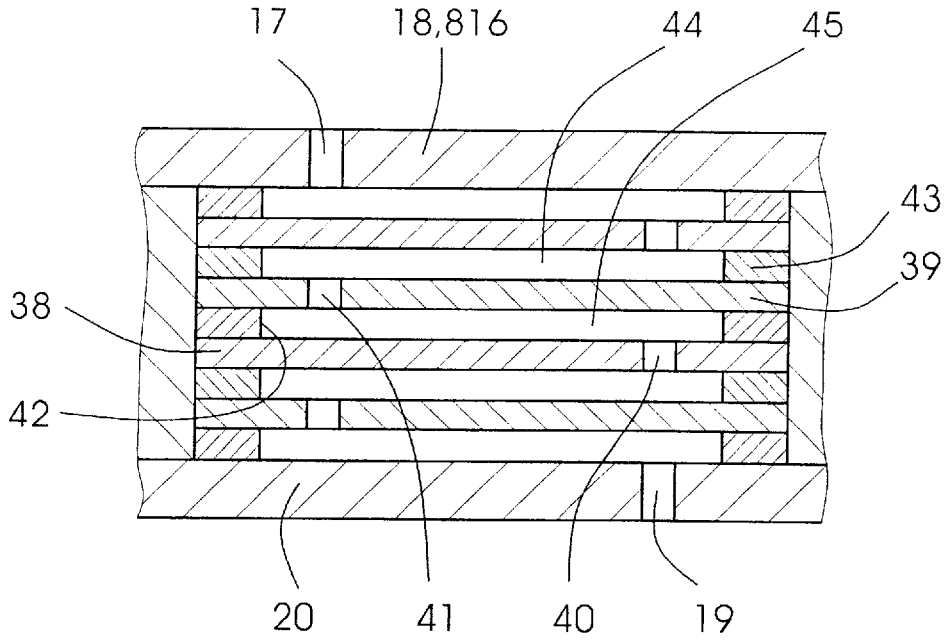
FIG. 8 is a fragmentary, diagrammatic, cross-sectional view of a fifth embodiment of the air throttle of FIG. 4.

FIG. 8 illustrates a cross-section of the air throttle 816 including perforated plates 38, 39 disposed one above the other in the throttle chamber 21. Of the perforated plates 38, 39, each has at least one hole 40, 41 that is offset in the plate plane in relation to at least one hole 41, 40 of the respectively adjacent perforated plate. It is, thus, the case that the holes 40, 41, which form a meandering air channel, are not aligned with one another and overlap closed plate surfaces of the perforated plates 38, 39. Spacer elements 42, 43 keep the perforated plates 38, 39 spaced apart and determine volumes of vortex chambers 44, 45, which are located between the perforated plates 38, 39 and have the blowing air flowing through them. The blowing air builds up in front of the holes 40, 41, which constitute the narrowing in the flow path, and forms vortices in the vortex chambers 44, 45. The throttle action of the air throttle 816, in the same way as the throttle action of the air throttles 616 and 716, is based on a reduction in the flow speed of the blowing air by virtue of the air flow being deflected a number of times in the throttle chamber 21.

The following is a description of how the machine 2 according to the invention functions.

Once a trailing edge 57 of the sheet 1, transported by the transporting cylinder 5, has passed a common tangential point 58 of the cylinders 4 and 5, a first air cushion, designated by A in FIG. 1, is generated between a current rear side of the sheet 1 and the circumferential surface 7 of the transporting cylinder 5 by the blowing air passing out of the air nozzles 8, 9 of the cylinder 5. The air cushion raises up the sheet 1 from the circumferential surface 7 with the spacing from the surface 7 increasing in the direction of the trailing edge 57 of the sheet 1.

At the same time as the air cushion A, the air nozzles 11, 12 and 46, 47 of the directing configuration 10 generate a second air cushion B between the directing configuration 10, or the directing surface thereof, and a current front side of the sheet.

The sheet 1 in such a case, which is subjected to blowing on both sides by the air nozzles 8, 9, 11, 12, 46, 47 as it is transported past the directing configuration 10, moves on a very stable trajectory that is more or less free from transverse acceleration.

The throttling of the throttled air nozzles 8, 9 of the transporting cylinder 5, and the resulting high level of effectiveness in the vicinity of the air nozzles 8, 9, make it possible for the abovementioned spacing between the trailing edge 57 and the circumferential surface 7 to be kept very small. The throttling of the throttled air nozzles 11, 12 of the directing configuration 10, and the resulting comparatively high (in relation to the small blowing-air-volume stream through the throttled blowing-air nozzles 11, 12) blowing-air-jet pressure of the throttled air nozzles 11, 12 in the vicinity of the throttled air nozzles 11, 12, also make it possible for the sheet 1 to be transported past the directing configuration 10 very closely to the directing configuration 10 and nevertheless absolutely reliably, without striking against the directing configuration 10.

In other words, a through-gap 59 between the transporting cylinder 5 and the directing configuration 10, the gap 59 having the sheet 1 passing through it without contact (and, for reasons of clarity, being illustrated in FIG. 1 as being exaggeratedly wide rather than narrow), may have very narrow dimensions. As a result, the air cushions A, B acting in the through-gap 59 retain the sheet 1 on a virtually ideally circular, and, thus, very stable, trajectory. A further advantage of the throttling of the throttled air nozzles 8, 9 and 11, 12 with the, or a respective, air throttle 416, 516, 616, 716, 816 results from the, thus, reduced blowing-air-volume stream through the air nozzles 8, 9 and 11, 12. The further advantage results because the blowing-air-volume stream through the respective air nozzle 8, 9, 11, 12 need not be suppressed by shut-off measures in that state of the air nozzle 8, 9, 11, 12 in which the air nozzle 8, 9, 11, 12 is no longer, or not yet, overlapped by the sheet 1 as it is transported. In other words, the so-called secondary air stream through the throttled air nozzles 8, 9 and 11, 12 is very small and tolerable, resulting in the elimination of any complex-configuration shut-off valves or the like for suppressing the secondary air stream.

The resilient mounting of the air nozzles 11, 12 that is shown in FIGS. 2 and 3 is advantageous as far as the processing of sheets 1 of different printing-material thicknesses is concerned. Due to its high level of inherent stiffness and of the greater centrifugal force, a thick, heavy sheet 1 (i.e., cardboard sheet) projects from the transporting cylinder 5 to a more pronounced extent 60 than a thin sheet 1 (i.e., paper sheet) that is less stiff and lighter. Compare the sheets 1 in FIGS. 2 and 3. So that the throttled air nozzle 12 subjects both a thick and a thin sheet 1 to optimal pneumatic action, the air nozzle 12, during processing of the sheet 1, is automatically extended out of the directing configuration 10, and advanced up to the sheet 1, by the spring 52 until there is an equilibrium between forces $F_F$ and $F_B$. See FIG. 2. $F_F$ designates a build-up force, caused by the ejected blowing air 61, of a local build-up of air between the air nozzle 12 and the sheet 1. With the spacing between the air nozzle 12 and the sheet 1 decreasing during the extending operation, the build-up pressure force $F_B$ increases until reaching the equilibrium of forces, in which an optimum spacing 60 between the air nozzle 12 and the sheet 1 corresponds to the optimal-effectiveness region in the vicinity of the air nozzle 12. In the case of a paper sheet—see FIG. 3—the air nozzle 12 thus extends further than in the case of a cardboard sheet. See FIG. 2. As a result, the spacing between the air nozzle 12 and the sheet 1, in each of the two cases, is set to the optimal spacing 60, which is constant regardless of the printing material, and the air nozzle 12 is, thus, adapted automatically to the printing material.

However, the spring mounting also causes the air nozzle 12 to be adapted automatically to the machine speed, the air nozzle 12 being made to follow the sheet 1 during each transverse movement of the sheet 1, and the optimal spacing 60 being maintained by the self-regulation of the air nozzle 12.

It is possible, for example, for the transverse movement to be caused by an increase in machine speed, i.e., an increase in the rotational speed of the transporting cylinder 5. As a result, the centrifugal force acting on the sheet 1 increases and the spacing between the trailing edge 57 and the transporting cylinder 5 increases and the spacing between the trailing edge 57 and the directing configuration 10 decreases. In such a case, the sheet 1 forces the air nozzle 12 back in the direction of the directing configuration 10 without contact, i.e., without coming into contact with the air nozzle 12, through an air cushion, which is located between the sheet 1 and air nozzle 12 and is produced by the local build-up of air, and counter to the action of the spring 52. The air nozzle is forced back until the optimal spacing 60, which has been lost by the transverse movement, is restored with very quick response. Appropriate co-ordination of the spring force $F_F$ and a characteristic curve of the spring 52 relative to the build-up pressure force $F_B$ that occurs is the precondition for satisfactory functioning.

As already been mentioned in the introduction, there are virtually no occurrences of such transverse movements if the running of the machine 2 according to the invention is not disrupted by changes in speed.

We claim:

1. A sheet-transporting device for use in a sheet processing machine, said device comprising:

a plurality of air nozzles disposed in a transporting cylinder, said air nozzles of said plurality of air nozzles disposed offset in relation to one another in a direction at an angle to a longitudinal axis of the transporting cylinder;

a directing configuration for directing the sheets along the transporting cylinder, said directing configuration having springs and a plurality of directing air nozzles and cooperating with the transporting cylinder to transport the sheets between said directing configuration and the transporting cylinder, at least some of said directing air nozzles of said plurality off directing air nozzles being throttled air nozzles, and said throttled air nozzles of said plurality of directing air nozzles having nozzle bodies and being resiliently mounted by said springs for forcing said nozzle bodies out of said directing configuration; and at least one of said plurality of air nozzles and said plurality of directing air nozzles having unthrottled air nozzles.

2. The sheet-transporting device according to claim 1, wherein said plurality of directing air nozzles include said throttled air nozzles and said unthrottled air nozzles.

3. The sheet-transporting device according to claim 1, wherein said throttled air nozzles are blowing-air nozzles.

4. The sheet-transporting device according to claim 1, wherein said unthrottled air nozzles are blowing-air nozzles.

5. The sheet-transporting device according to claim 1, wherein:

said directing configuration includes a wall having joints formed therein; and said directing throttled air nozzles are movably mounted in said joints.

6. The sheet-transporting device according to claim 1, including air throttle fluidically communicating with at least one of said throttled air nozzles and said directing air nozzles.

7. The sheet-transporting device according to claim 6, wherein said air throttle is a loose fill.

8. The sheet-transporting device according to claim 6, wherein said air throttle is a filter throttle element.

9. The sheet-transporting device according to claim 6, wherein said air throttle is a helical air channel.

10. The sheet-transporting device according to claim 6, wherein said air throttle includes projecting air weirs and vortex chambers located between said air weirs.

11. The sheet-transporting device according to claim 6, wherein said air throttle includes perforated plates disposed one above another and vortex chambers located between said plates.

12. In a sheet-fed rotary printing machine having a transporting cylinder for transporting sheets, the transporting cylinder having a longitudinal axis the improvement comprising, a sheet-transporting device comprising:

a plurality of air nozzles disposed in the transporting cylinder, said air nozzles of said plurality of air nozzles disposed offset in relation to one another in a direction at an angle to the longitudinal axis;

a directing configuration for directing the sheets along the transporting cylinder, said directing configuration having springs and a plurality of directing air nozzles and cooperating with the transporting cylinder to transport the sheets between said directing configuration and the transporting cylinder, at least some of said directing air nozzles of said plurality of directing air nozzles being throttled air nozzles, and said throttled air nozzles of said plurality of directing air nozzles having nozzle bodies and being resiliently mounted by said springs for forcing said nozzle bodies out of said directing configuration; and at least one of said plurality of air nozzles and said plurality of directing air nozzles having unthrottled air nozzles.

13. A sheet processing machine having a transporting cylinder for transporting sheets, the machine comprising:

a plurality of air nozzles disposed in a transporting cylinder having a cylinder longitudinal axis, said air nozzles of said plurality of air nozzles disposed offset in relation to one another in a direction at an angle to the cylinder longitudinal axis;

a directing configuration for directing the sheets, said directing configuration having springs and a plurality of directing air nozzles and cooperating with the transporting cylinder to transport the sheets between said directing configuration and the transporting cylinder, at least some of said directing air nozzles of said plurality of directing air nozzles being throttled air nozzles, and said throttled air nozzles of said plurality of directing air nozzles having nozzle bodies and being resiliently mounted by said springs for forcing said nozzle bodies out of said directing configuration; and at least one of said plurality of air nozzles and said plurality of directing air nozzles having unthrottled air nozzles.

* * * * *